United States Patent [19]

Stephenson et al.

[11] 4,163,880

[45] Aug. 7, 1979

[54] WEB-SENSITIVE SWITCH ASSEMBLY

[75] Inventors: Robert L. Stephenson, Sterling Heights; William R. Fox, Warren; James A. Gavagan, Center Line, all of Mich.

[73] Assignee: Allied Chemical Corporation, Morris Township, Morris County, N.J.

[21] Appl. No.: 858,132

[22] Filed: Dec. 7, 1977

[51] Int. Cl.[2] ..... H01H 3/16; A62B 35/00

[52] U.S. Cl. ..... 200/61.58 B; 200/61.15; 242/107.4 R

[58] Field of Search ..... 200/61.13, 61.15, 61.16, 200/61.18, 61.58 B, 240, 241, 242, 284, 332, 294, 295, 296, 164 R, 245–247; 242/107.4 R; 280/744

[56] References Cited

U.S. PATENT DOCUMENTS

| | | | |
|---|---|---|---|
| 3,504,336 | 3/1970 | Boblitz | 200/61.58 B X |
| 3,632,059 | 1/1972 | Loose | 200/61.58 B X |
| 3,712,970 | 1/1973 | Adie | 200/164 R |
| 3,767,134 | 10/1973 | Morales | 200/61.58 B X |
| 3,858,019 | 12/1974 | Muri et al. | 200/241 |
| 3,862,727 | 1/1975 | Fisher | 200/61.58 B X |
| 3,890,003 | 6/1975 | Close | 200/61.58 B X |
| 4,000,385 | 12/1976 | Colasanti | 200/61.58 B |

*Primary Examiner*—James R. Scott

*Attorney, Agent, or Firm*—Roger H. Criss; Virginia Andrews

[57] ABSTRACT

A switch assembly is provided for use in sensing a seat belt spool condition in a seat belt retractor assembly. Features of the switch assembly are a switch housing in which is mounted a conductive member which forms both a fixed contact and a male terminal at its respective ends, a movable contact element which is supported for selective wiping contact with the fixed contact end of the conductive member, and actuating means which moves the movable contact element into wiping contact with the fixed contact end of the conductive member in response to a predetermined amount of seat belt webbing being stored on the spool of the seat belt retractor and which permits the movable contact element to move out of wiping contact in response to a predetermined amount of seat belt webbing being removed from the retractor.

9 Claims, 7 Drawing Figures

WEB-SENSITIVE SWITCH ASSEMBLY

BACKGROUND OF THE INVENTION

1. Field of the Invention

This invention relates to a switch for use in sensing a seat belt spool condition in a seat belt retractor assembly, and more particularly to a web-sensitive switch assembly which activates or deactivates a seat belt warning system, such as a light or buzzer, in response to the amount of seat belt webbing stored on the spool of the seat belt retractor.

2. Description of Prior Art

It is well known to provide warning systems to remind vehicle occupants to fasten their seat belts. Due to the current use of seat belt retractor assemblies in vehicles, the most serviceable warning systems are those which are retractor-related and which operate a switch response to a seat belt spool condition. Unfortunately, many retractor-related warning switches are dependent on design features of the retractor assembly itself, and hence are undesirable due to their non-adaptability to existing retractor assemblies. Keys to adaptability of such switch assemblies are compactness and independent adjustment. Further advantageous features would include easy and inexpensive fabrication, adjustment for accommodation of tolerance accumulation even when fully assembled and mounted, and a minimum number of parts.

SUMMARY OF THE INVENTION

The present invention provides a switch assembly for use in sensing a seat belt spool condition in a seat belt retractor assembly. The switch assembly comprises a switch housing, a conductive member, aperture means, a movable contact element, actuating means, and means for mounting the switch housing on the seat belt retractor assembly. The conductive member is mounted in the housing with one end of the conductive member forming a fixed contact and the opposite end forming a male terminal for electrical connection. Aperture means is provided in the housing for access to the opposite end of the conductive member. The movable contact element is supported for selective wiping contact with the one end of the conductive member which forms a fixed contact. The actuating means has access to the movable contact element through the housing. The actuating means moves the movable contact element into wiping contact with the one end of the conductive member which forms a fixed contact in response to a predetermined amount of seat belt webbing being stored on the spool of the seat belt retractor. The actuating means also permits the movable contact element to move out of wiping contact with the one end of the conductive member forming a fixed contact in response to a predetermined amount of seat belt webbing being removed from the seat belt retractor.

The present invention provides a switch assembly which is compact and capable of adjustment independent of the seat belt retractor assembly with which it is utilized. In fact, the switch assembly can be adjusted for accommodation of tolerance accumulation even when fully assembled and mounted. Further, the switch assembly comprises a minimum number of parts which are conducive to easy and inexpensive fabrication.

DESCRIPTION OF THE PREFERRED EMBODIMENT

Figures 1, 2:
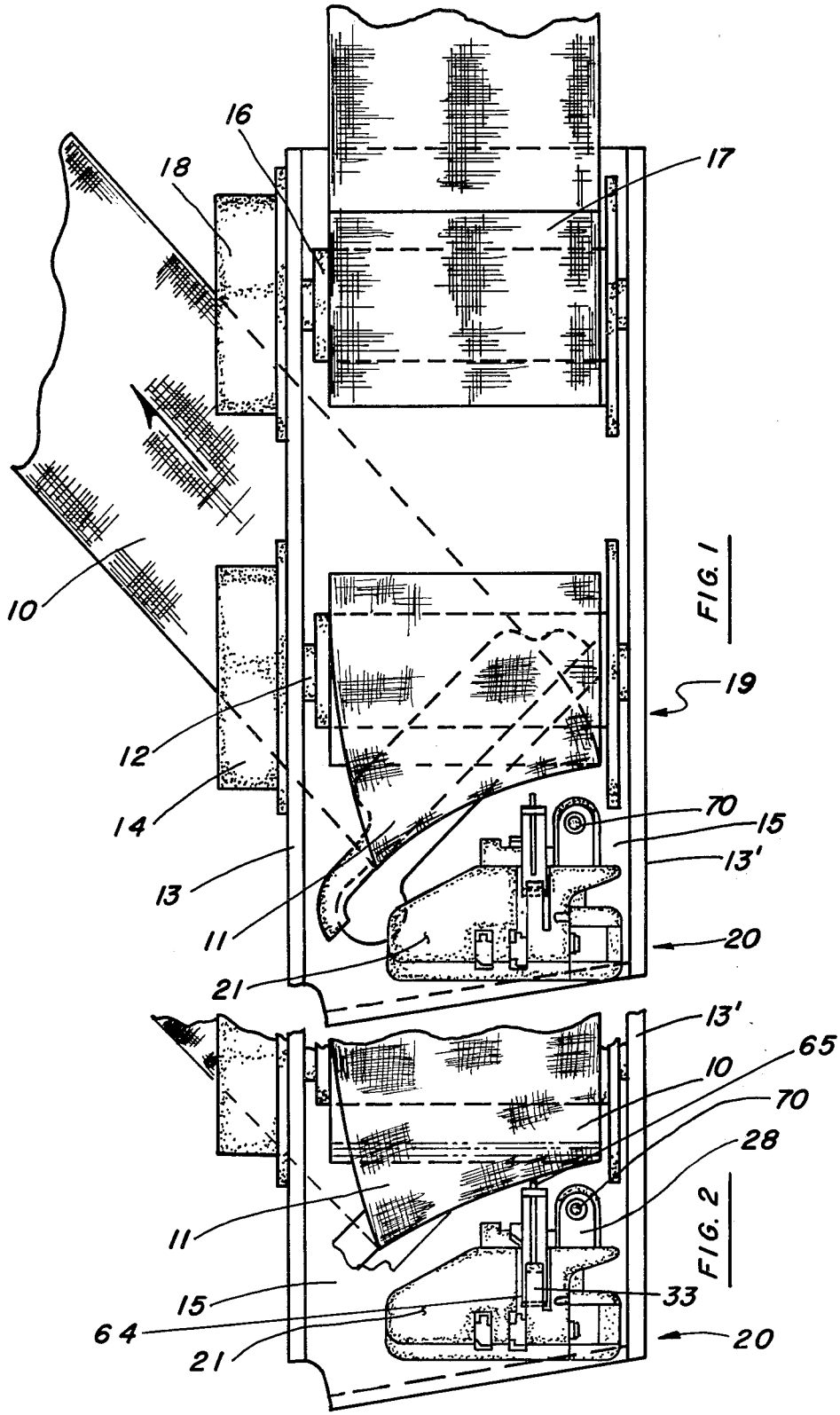
FIG. 1 is a top plan view of the present invention mounted in a seat belt retractor assembly showing the switch assembly in open position when the seat belt webbing is removed a predetermined amount from a seat belt retractor.
FIG. 2 is a top plan view of the present invention mounted in a seat belt retractor assembly showing the switch assembly in closed position when the seat belt webbing is fully stored on the spool of a seat belt retractor.

With reference to the drawings, and particularly FIGS. 1 and 2, there is illustrated an adjustable switch 20 for use in a seat belt retractor assembly. The retractor may be of a single spool type, or the double spool type depicted and as disclosed in copending application Ser. No. 817,636 of Stephenson et al. filed July 21, 1977. With reference to FIG. 1, such a retractor 19 comprises lower and upper spools 12 and 16 journalled on upstanding, metal sidewalls 13 and 13' disposed within a plastic cover (unshown), and carrying, respectively, lap seat belt webbing 10 and shoulder seat belt webbing 17 in helical wrap. Spools 12 and 16 are spring-biased so as to return the belts to the fully retracted position by, respectively, helical springs 14 and 18. A metal base 15 of retractor 19 is adapted for attachment to a vehicle frame in a conventional manner.

The switch assembly of the present invention (FIGS. 3–7) comprises a switch housing 21, a conductive member 40 mounted in switch housing 21, aperture means 22 provided in switch housing 21, a movable contact element 50, actuating means, and means for mounting switch housing 21 on the seat belt retractor assembly.

Switch housing 21, which is preferably made of a suitable plastic, has sidewalls 23, 24, 25 and 26 and an upper portion 27. Means is provided for mounting switch housing 21 on the seat belt retractor assembly and comprises attaching means which may be, as depicted in the drawings, a portion of housing sidewall 23 in the form of a projecting tab 28 with an aperture therethrough and rivet 70. A registering aperture is provided in the base 15 of retractor 19. Attachment of switch housing 21 to retractor base 15 is described in detail below. It should be noted, however, that when switch housing 21 is mounted on retractor base 15, the retractor base 15 also forms the base of switch housing 21.

Conductive member 40 is mounted in switch housing 21 with one end 41 forming a fixed contact and the opposite end 42 forming a male terminal for electrical connection. Conductive member 40, which is made of conductive metal, preferably brass, is essentially a flat blade which has been bent or angled to provide flat contact area forming fixed contact end 41. Notches 43 and 43' are provided in conductive member 40 and mate with projecting posts or ribs 29 and 29', respectively, in the cavity of switch housing 21 when conductive member 40 is initially placed in switch housing 21 (see FIGS. 3 and 7). In order to retain conductive member 40 in place, conductive member 40 is pushed to the right (with respect to FIGS. 3 and 7) until angled finger 44 snaps over and into abutment with rib 30 on housing sidewall 25; simultaneously, the tangs between notches 43 and 43' slide into abutment with ribs 29', while the other portions of conductive member 40 immediately adjacent and to the left of notches 43 and 43' slide underneath ribs 29 and 29', respectively.

Figure 4:
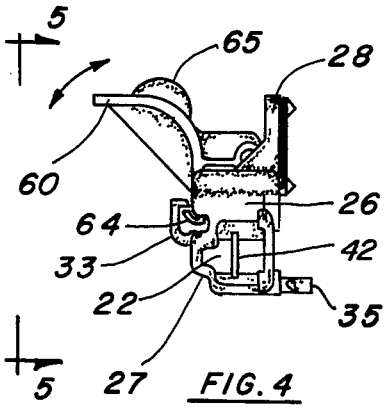
FIG. 4 is a view of the switch assembly taken along the lines 4—4 of FIG. 3.
Figure 5:
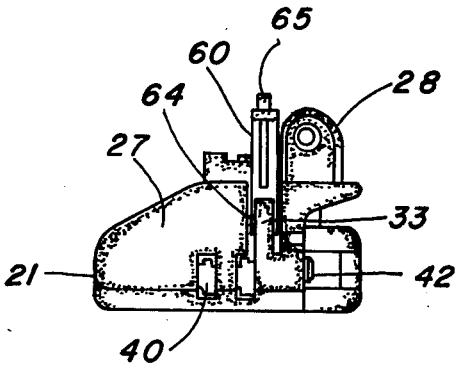
FIG. 5 is a top plan view of the switch assembly taken along the lines 5—5 of FIG. 4.
Figure 6:
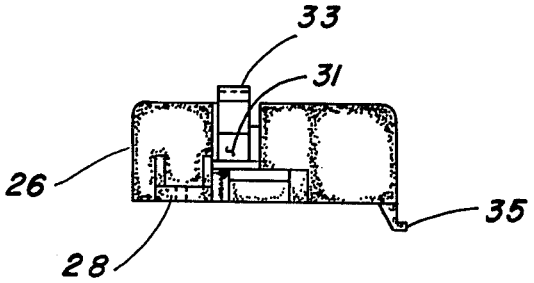
FIG. 6 is a view taken along the lines 6—6 of FIG. 3 with lever arm 60 removed.
Figure 7:
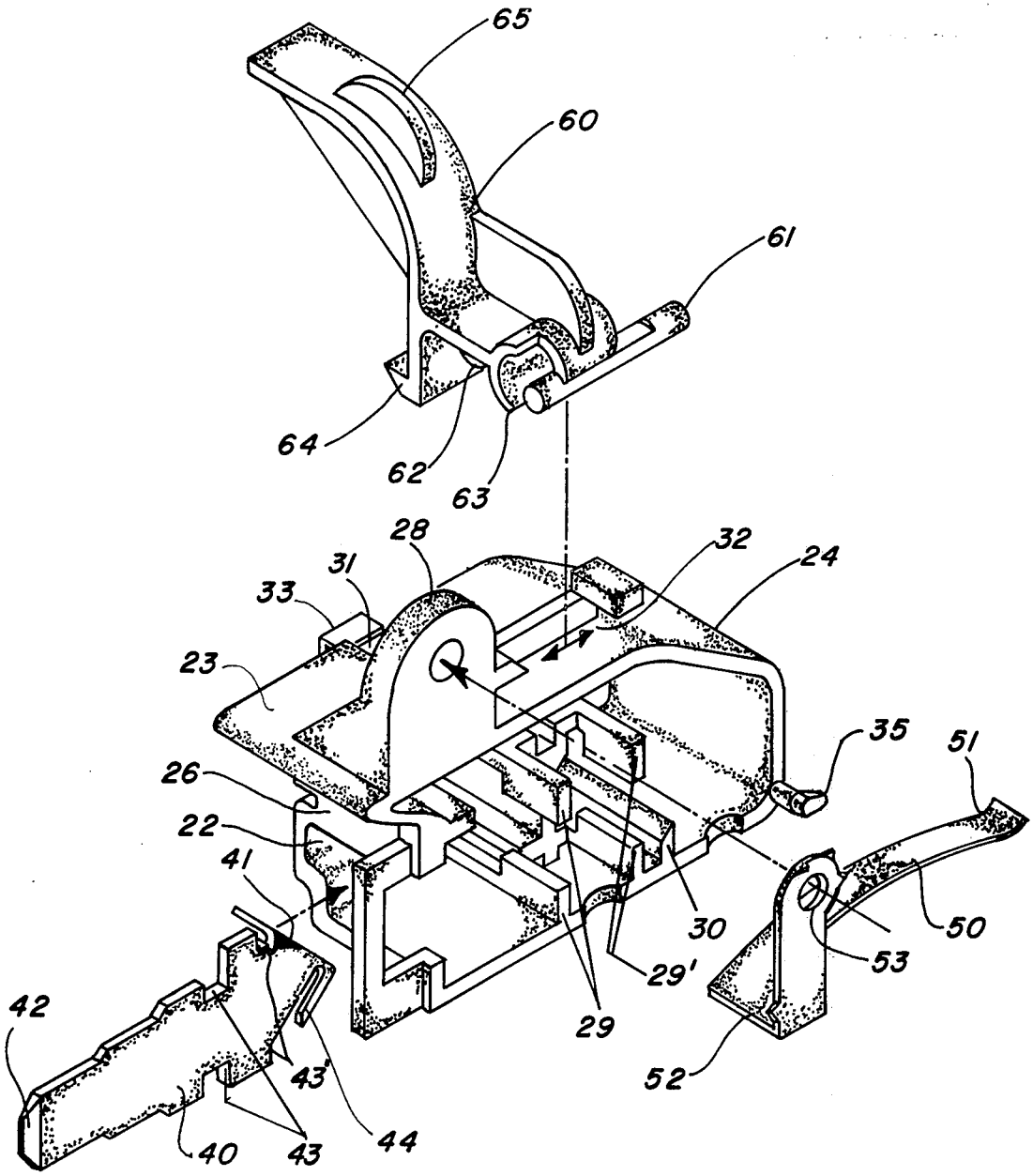
FIG. 7 is an exploded assembly view of the switch assembly.

Aperture means 22 is provided in switch housing sidwall 26 for access through switch housing 21 to the male terminal end 42 of conductive member 40. With reference to FIGS. 4 and 7, switch housing sidewall 26 is shaped so as to form along with male terminal end 42 of conductive member 40 a male terminal receptacle for electrical connection with a conventional wiring harness plug (unshown) which is connected to an audio or visual alarm. It should be noted that male terminal end 42 of conductive member 40 is disposed within the cavity of switch housing 21 such that when switch 20 is fully assembled, mounted, and connected to a wiring harness plug, no part of the male terminal end 42 of conductive member 40 is left exposed.

Figure 3:
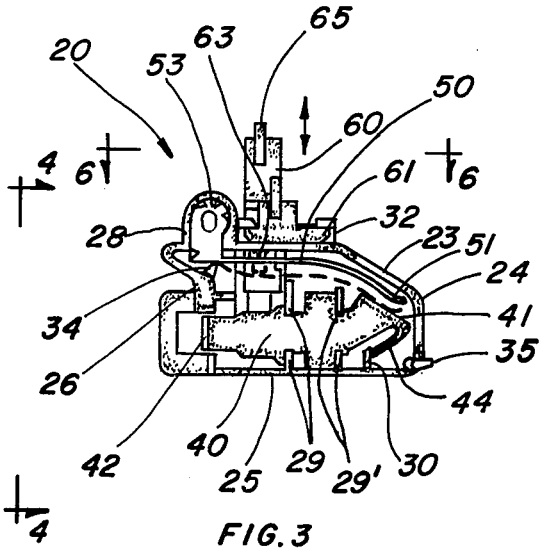
FIG. 3 is a bottom plan view of the switch assembly in the open position, with the closed position indicated in phantom.

Movable contact element 50 comprises a movable spring contact blade which is formed of metal, preferably beryllium copper for purposes of extended life. With reference to FIG. 7, it can be seen that one end 51 of the blade comprising movable contact element 50 is turned up to form a contact shoe while the opposite end 52 has a projection extending laterally therefrom. The portion of the blade between these two ends extends in a straight line from projection end 52 for a short distance and then curves downward toward contact shoe end 51. The projection at projection end 52 extends laterally for a short distance and then bends at approximately a right angle to the general plane of the blade. The angled-off portion is shaped in the form of a projecting tab 53 with an aperture similar to and for register with projecting tab 28 of switch housing 21. Projecting tab 53 of movable contact element 50 is placed between and in register with projecting tab 28 of switch housing 21 and an aperture (unshown) in the retractor base 15. A rivet 70 connects these three elements and exerts a compressive load thereon in order to mount switch housing 21 on the retractor base 15 and to support movable contact element 50 in relation to switch housing 21. Grounding occurs through contact of projecting tab 53 of movable contact element 50 with retractor base 15. The remainder of movable contact element 50 is thereby located in the cavity of switch housing 21 such that its contact shoe end 51 is in spaced apart relation to but capable of forced, wiping engagement (or contact) with fixed contact end 41 of conductive member 40 (see FIG. 3). It should be noted that insulation of movable contact element 50 and conductive member 40 from one another occurs solely through the remoteness of their fixed positions within switch housing 21. Any joints, ribs, or stops forming an integral part of switch housing 21 function only as locators, stiffeners, or supportive structures. With reference to FIG. 3, a fulcrum extension 34 of switch housing 21 is located adjacent to movable contact element 50 near projection end 52 on the side of movable contact element 50 opposing switch housing sidewall 23. An aperture 31 (see FIG. 6) is provided in switch housing sidewall 23 adjacent to the intermediate portion of movable contact element 50 and to the right of fulcrum extension 34. The functions of fulcrum extension 34 and aperture 31 are explained below.

The actuating means of the preferred embodiment comprises a lever arm 60 which is preferably made of a suitable plastic. Lever arm 60 has at one end thereof a rod 61 which slidably interfits into a mating socket 32 formed on switch housing sidewall 23 for pivotal movement of lever arm 60 in an arc transverse to the plane of switch housing sidewall 23. The portion of lever arm 60 adjacent switch housing sidewall 23 has a rounded protuberance 62 and a small finger 63 (see FIGS. 3 and 7) which move into the cavity of switch housing 21 via aperture 31 in sidewall 23 when lever arm 60 pivots in that direction. Rounded protuberance 62 and the intermediate straight portion of movable contact element 50 are in actuating register with one another, and finger 63 serves in conjunction with fulcrum extension 34 of switch housing 21 to retain movable contact element 50 within the cavity of switch housing 21 prior to assembly with rivet 70. Lever arm 60 also has a retainer member 64 which engages with a similar but opposing retainer member 33 formed in the upper portion 27 of switch housing 21. Switch housing retainer member 33 (see FIG. 6) also functions as a travel stop to inhibit pivotal movement of lever arm 60 beyond a preselected point away from switch housing 21. Housing sidewall 23 forms another travel stop to inhibit pivotal movement of lever arm 60 beyond a predetermined point toward switch housing 21. To connect lever arm 60 to switch housing 21, rod 61 is slid into socket 32 and lever arm 60 is pivoted toward switch housing 21 where lever arm retainer member 64 is snapped into engagement with switch housing retainer member 33. The remove lever arm 60 from switch housing 21, switch housing retainer member 33 is pulled upward and lever arm 60 is pivoted away from switch housing 21 until retainer member 64 is clear of switch housing 21. Rod 61 is then removed from socket 32. The side of lever arm 60 remote from switch housing 21 is curved and has a rounded portion 65 which contacts the outer surface 11 of lap seat belt webbing 10 stored on spool 12 of seat belt retractor 19, when the switch assembly is mounted to retractor base 15.

Adjustable switch 20 is assembled as described and is mounted on a retractor base 15 adjacent to a seat belt retractor assembly. The switch 20 is positioned so that rounded portion 65 of lever arm 60 is biased into following contact with the outer surface 11 of a fully retracted seat belt webbing 10 stored on spool 12 by the force of movable contact element 50.

With reference to FIGS. 2 and 3, full retraction of seat belt webbing 10 causes outer surface 11 to bear against rounded portion 65 of lever arm 60. Rod 61, and consequently lever arm 60, is pivoted towards switch housing 21 as far as possible, i.e., until rounded protuberance 62 has moved into the cavity of switch housing 21 and is in actuating register with and has deflected movable contact element 50 into wiping electrical contact with fixed contact end 41 of conductive member 40. An audio and/or visual alarm electrical circuit is now closed via a wiring harness plug which is connected to male terminal end 42 of conductive member 40 to indicate the fully retracted state of spool 12.

As shown in FIGS. 1 and 3, the widthdrawl of a predetermined amount of lap seat belt webbing 10 from the seat belt retractor 19 will result in the opening of switch 20. As movable contact element 50 is spring-biased against rounded protuberance 62 of lever arm 60, a decrease in the amount of seat belt webbing 10 stored on spool 12 causes physical displacement or pivot of lever arm 60 away from switching housing 21 and towards the remaining seat belt webbing 10. This displacement permits contact shoe end 51 of movable contact element 50 to achieve its normal spaced apart relation with respect to fixed contact end 41 of conductive member 40, thus opening the switch 20. The pivot of lever arm 60 away from switch housing 21 is inhibited beyond a predetermined point by engagement of retainer members 64 and 33. In order to change the amount of seat belt webbing 10 which must be withdrawn in order to open switch 20, simple dimensional changes can be made in fabricating lever arm 60, more especially rounded portion 65.

One of the primary advantages of the switch assembly comprising the present invention is its adjustment feature. Lever arm 60 can be disengaged from the assembly and replaced by another with a different lever dimension even while the switch assembly is mounted to retractor base 15. This is best accomplished by withdrawing seat belt webbing 10 as far as possible and then snaping out and replacing lever arm 60 as described above. Also, lever arms with only slightly varying dimensions can be manufactured in order to accommodate tolerance accumulation in the fabrication of the other components.

Another feature of the present invention is conductive member 40. Conductive member 40 doubles as a fixed contact and as a male terminal for electrical connection. Further, the terminal housing is integral with the switch housing, leaving no part of the male terminal end 42 of conductive member 40 exposed when switch 20 is fully assembled, mounted, and electrically connected to a wiring harness plug.

Besides the aforementioned features, switch housing 21 is easily located and mounted with respect to the seat belt retractor assembly. Projecting tab 28 keys the switch housing 21 to retractor base 15 and serves as a locator while rivet 70 and housing leg 35 locate and secure switch housing 21 in position. Housing leg 35 (see FIGS. 6 and 7), which projects from switch housing 21 at approximately the juncture of housing sidewalls 24 and 25, is preferably beveled on one side and has a lip at its free end. To mount switch housing 21 to retractor base 15, housing leg 35 is slid into a registering aperture (unshown) in retractor base 15, and then rivet 70 is attached to secure projecting tabs 28 and 53 and retractor base 15. After switch housing 21 has been mounted, the lip of housing leg 35 prevents switch housing 21 from being pulled directly out of retractor base 15 by coming into abutment with the remote edge of retractor base 15. Housing leg 35 further serves to prevent the rotation of switch housing 21 about rivet 70. Rivet 70 compresses the stationary end of movable contact element 50 against retractor base 15 to achieve an electrical connection. Rivet 70 serves only as a mechanical clamp and not as an electrical conductor.

The shape and construction of movable contact element 50, its relationship to lever arm 60 and fixed contact end 41 of conductive member 40, and flexure of movable contact element 50 about fulcrum extension 34, advantageously achieve a self-cleaning wiping action between the contact surfaces, thus ensuring a positive connection. Further, in the most preferred embodiment, movable contact element 50 is designed so as to have a three to one ratio of motion of the contact point with respect to the point where lever arm 60 applies its load. This provides faster opening and closure of switch 20 with smaller increments of seat belt webbing 10 displacement.

The invention thus provides a switch 20 which can be made up of a minimum number of five parts: switch housing 21, lever arm 60, movable contact element 50, conductive member 40, and rivet 70.

In this disclosure, there is shown and described only the preferred embodiment of the invention, but it is to be understood that the invention is capable of other and different embodiments, and its several details are capable of various obvious modifications, all without departing from the inventive spirit thereof. It is intended that this invention be limited only as set forth in the following claims.

We claim:

1. A switch assembly for use in sensing a seat belt spool condition in a seat belt retractor assembly comprising:

a. a switch housing;

b. a conductive member mounted in said housing, one end of said conductive member forming a fixed contact and the opposite end forming a male terminal for electrical connection;

c. aperture means provided in said housing permitting access to said opposite end of said conductive member;

d. a movable contact element, said movable contact element being supported for selective wiping contact with said one end of said conductive member;

e. actuating means, said actuating means having access to said movable contact element through said housing, said actuating means moving said movable contact element into wiping contact with said one end of said conductive member in response to a predetermined amount of seat belt webbing being stored on the spool of said seat belt retractor, said actuating means permitting said movable contact element to move out of wiping contact with said one end of said conductive member in response to a predetermined amount of seat belt webbing being removed from said seat belt retractor said actuating means comprising a lever arm, said lever arm being pivotally connected to said housing and in contact with the outer surface of a roll of seat belt webbing rolled on the spool of a seat belt retractor assembly; and f. means for mounting said switch housing on said seat belt retractor assembly.

2. The switch assembly of claim 1 including a proturberance on said lever arm which moves into said housing for actuating register with said movable contact element.

3. The switch assembly of claim 1 wherein the pivotal movement of said lever arm is inhibited in either direction of movement at preselected points by said housing.

4. The switch assembly of claim 2 wherein said movable contact element comprises a movable spring contact which is in actuating register with said protuberance of said lever arm and wherein said movable spring contact biases said lever arm away from said housing.

5. The switch assembly of claim 1 wherein said means for mounting said switch housing on said seat belt retractor assembly comprises attaching means, said attaching means securing said housing and grounding said movable contact element to said seat belt retractor assembly.

6. The switch assembly of claim 5 wherein said attaching means comprises a rivet, and wherein said housing and said movable contact element each have portions thereof which are in register with one another and through which said rivet passes.

7. The switch assembly of claim 1 wherein said switch housing also forms a terminal housing for said opposite end of said conductive member forming a male terminal.

8. The switch assembly of claim 1 wherein said lever is mounted for pivotal movement in an arc transverse to the plane of said switch housing.

9. The switch assembly of claim 1 wherein said lever arm is removed from said switch housing.

* * * * *